United States Patent [19]

Brewer

[11] 4,205,799

[45] Jun. 3, 1980

[54] SHREDDING APPARATUS

[75] Inventor: John C. Brewer, Salt Lake City, Utah

[73] Assignee: Garbalizer Corporation of America, Salt Lake City, Utah

[21] Appl. No.: 947,108

[22] Filed: Sep. 29, 1978

[51] Int. Cl.[2] ..... B02C 13/04

[52] U.S. Cl. ..... 241/243; 241/285 B; 241/294; 241/DIG. 31

[58] Field of Search ..... 241/190, 222, 236, 243, 241/285 A, 285 B, 294, DIG. 31

[56] References Cited

U.S. PATENT DOCUMENTS

| | | | |
|---|---|---|---|
| 2,853,247 | 9/1958 | Anderson | 241/190 |
| 2,890,840 | 6/1959 | Fletcher et al. | 241/222 U |
| 3,060,778 | 10/1962 | Karber | 241/222 X |
| 3,396,914 | 8/1968 | Liebman | 241/236 X |
| 3,840,187 | 10/1974 | Brewer | 241/243 X |
| 4,000,860 | 1/1977 | Gotham | 241/285 B X |

*Primary Examiner*—Howard N. Goldberg

*Attorney, Agent, or Firm*—Ronald E. Barry

[57] ABSTRACT

A shredding apparatus including a housing or hopper and a shredding assembly positioned within the housing or hopper. The shredding assembly including a cutter bar assembly and a rotary blade assembly. Each of the assemblies including a number of identical cutter blades which are interchangeable with each other and are individually reversible. The cutter bar assembly also including a cutter bar positioned in abutting engagement with one end of each of the cutter blades mounted on the cutter bar assembly. The cutter bar including cutting edges on each side so it can be reversed with respect to the cutter blades. The cutter blades on the rotary cutter bar assembly are arranged to shear waste material at a downwardly and outwardly inclined angle so that the cutter blade acts to draw or pull waste material into the shredder assembly. The hopper or housing being provided with an easy access door on the front wall which can be pivoted outwardly from the hopper.

25 Claims, 12 Drawing Figures

SHREDDING APPARATUS

BACKGROUND OF THE INVENTION

Shredding apparatus of the type contemplated herein has been the subject of a number of patents of the present applicant. U.S. Pat. No. 3,578,252 entitled "Industrial Shredding Apparatus", U.S. Pat. No. 3,708,127 entitled "Cutter and Shearing Mechanism"; and U.S. Pat. No. 3,840,187 entitled "Shredder Mechanism and Improvements Therein", each of which disclose shredding apparatus which has been successfully used for shredding waste materials such as garbage, industrial waste, tires, trash, and so forth. In the operation of these devices, it has become apparent that deficiencies exist in the feeding of materials to the shredding assembly; the ability to obtain access to the housing for maintenance and repair of the shredding assembly; and uneven wear of the blades in the shredding assembly. There has also been considerable effort directed toward improvements in the ability of the shredding apparatus to clear shredded material so that it does not become lodged in the shredding assembly.

SUMMARY OF THE INVENTION

The improved shredder disclosed herein overcomes the above deficiencies by providing interchangeable cutter blades in the shredding assembly, improved feed of waste materials through the shredding assembly to the shredder and easy access to the shredding assembly for maintenance and repair.

Eacy access to the shredding assembly has been accomplished by providing a hinged door in the front wall of the housing or hopper which can be easily released from the front wall and opened to allow personnel to enter the housing or hopper. This portion of the front wall has also been provided with a guide in the form of an inclined wall which aids in directing the material toward the shredding assembly.

The flow of materials to the shredding assembly has been improved by arranging the cutter blades on the rotary blade assembly and on the cutter bar assembly at a downwardly and outwardly inclined angle with respect to the shaft of the rotary cutter assembly, so that the blades on the rotary cutter assembly act to pull waste materials into the cutter bar assembly.

The life of the cutter blades and the cutter bar has been increased by providing cutting edges on all four edges of both the cutter blades and the cutter bar. The cutter blades on both the cutter bar assembly and the cutter blade assembly are also identical so that they can be interchanged and reversed in order to use all of the cutting edges available.

FIGURES

DESCRIPTION OF THE INVENTION

Figure 1:
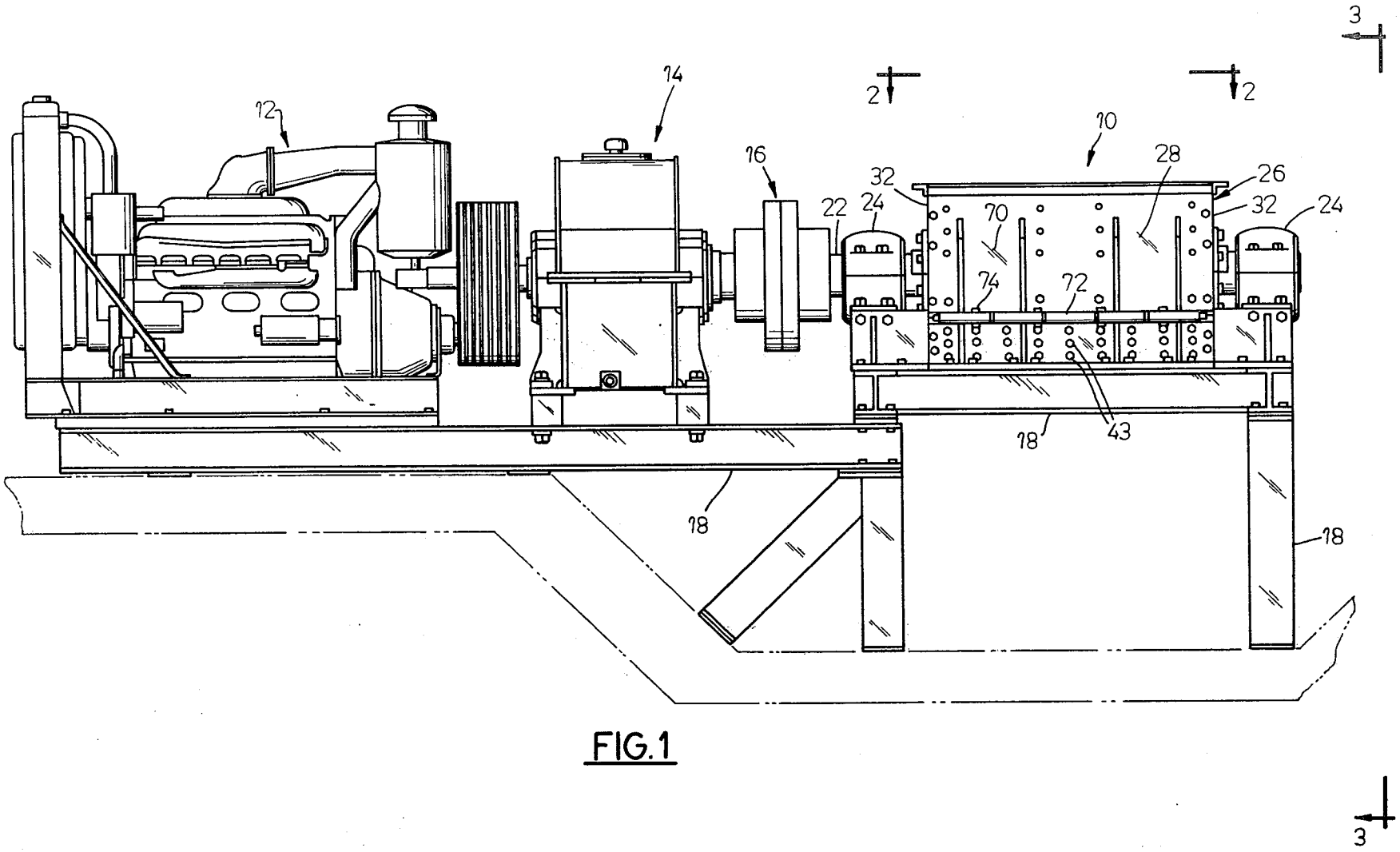
FIG. 1 is a side elevation view of the shredder according to the present invention.

Referring to FIG. 1, the shredder 10 of the type contemplated herein is shown driven by an internal combustion engine 12 through a reduction gear 14 and a coupling 16. The shredder can be supported on any base structure such as the I-beam structure 18, shown in FIG. 1, or on a movable support such a truck chassis or trailer. Although an internal combustion engine 12 has been shown as the means for driving the shredder any other power source can be used which will provide the required torque for the shredding apparatus.

Figure 2:
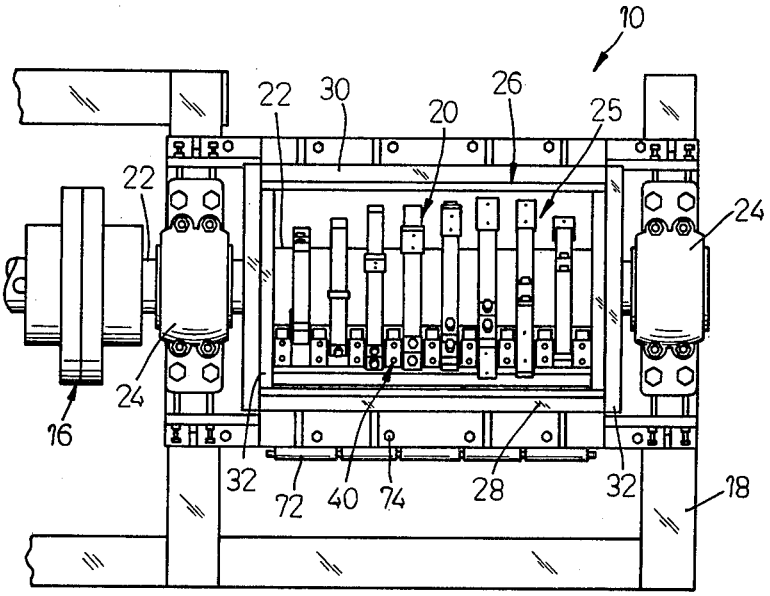
FIG. 2 is a top view of the housing or hopper for the shredding assembly taken on line 2—2 of FIG. 1.
Figure 3:
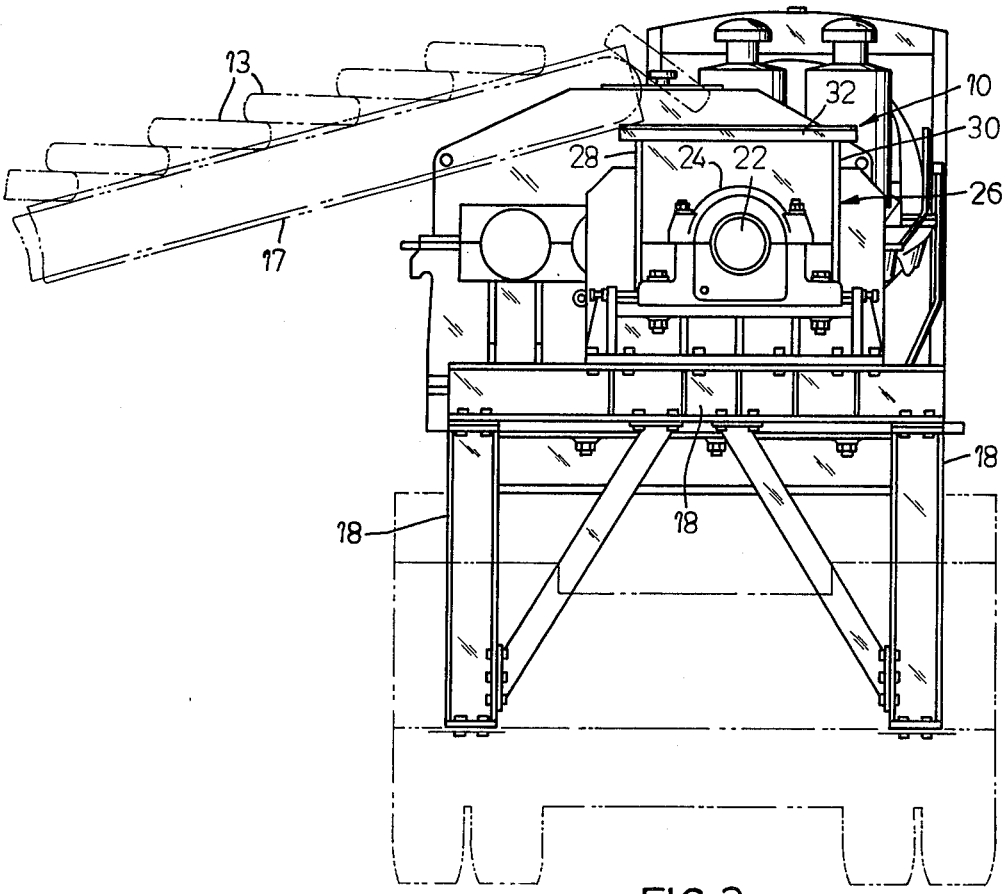
FIG. 3 is an end view taken on line 3—3 of FIG. 1 showing a conveyor for feeding materials such as tires to the top of the housing or hopper.
Figure 4:
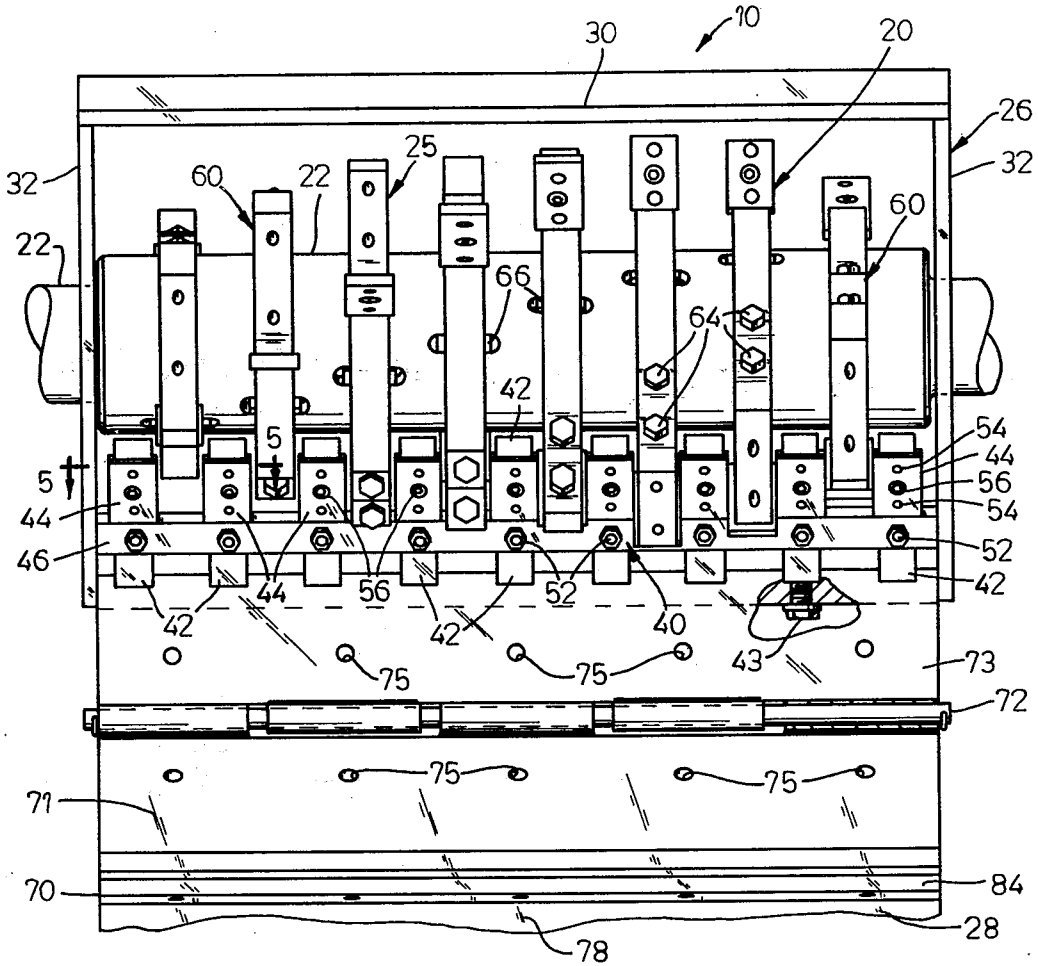
FIG. 4 is a top view of the housing or hopper with the front wall opened to allow access to the shredding assembly.

Referring to FIGS. 2 and 3 waste material such as tires 13 are shown being fed to a shredder housing or hopper 26 by a conveyor 17 which drops the material directly onto a shredding assembly 20. The tires are shredded in passing through the shredding assembly and the shredded material drops straight through the shredding assembly 20 into a hopper or straight through the shredding assembly 20 into a hopper or conveyor (not shown) provided beneath the hopper 26. The hopper 26 includes a front wall 28, a back wall 30 and a pair of end walls 32.

The shredding assembly 20 includes a rotary cutter blade assembly 25 and a stationary cutter bar assembly 40. The rotary cutter blade assembly 25 includes shaft 22 which extends outwardly through openings provided in the end walls 32. The shaft is journeled in bearings 24 provided at each end of the hopper 26.

CUTTER BAR ASSEMBLY

Referring to FIGS. 4 through 8, the cutter bar assembly 40 includes a number of stationary blade holders 42 which are mounted on the front wall 28 by means of a number of bolts 43. Plates 42 are arranged in a parallel equally spaced relation and extend upwardly from the bottom of the front wall toward the shaft 22 of the rotary cutter blade assembly 25. An arcuate surface 29 is provided at the upper end of the blade holder 42 which conforms to and is positioned in close proximity to the shaft 22.

Means are provided on each of the blade holders 42 for shearing waste material as it passes through the shredding assembly. Such means is in the form of a number of cutter blades 44 and a cutter bar 46.

Figure 6:
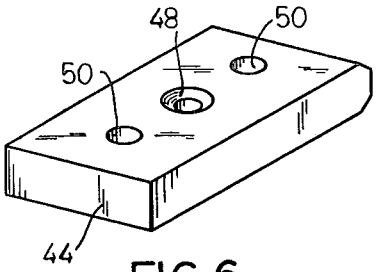
FIG. 6 is a perspective view of one of the cutter blades.

In this regard the cutter blades 44, as seen in FIG. 6, are provided with a central opening 48 which is countersunk on both sides of the cutter blade 44 and a pair of open ended holes 50. The cutter blades 44 are mounted on the blade holders in abutting engagement with the cutter bar 46 and are secured thereto by means of flathead cap screws 56. Means are provided for maintaining the alignment of the cutter blades on the blade holders 42. Such means is in the form of a pair of fixed pins 54 provided in holes 55 in the blade holders 42. The pins 54 are arranged to extend part way into the holes 50 provided in the cutter blades. It should be noted that the cutter blades can be turned over to use the cutting edges provided on all four edges of the side walls of the cutter blades.

The cutter bar 46 is secured to the blade holders 42 by means of bolts 52 in a perpendicular relation to the longitudinal axis of the cutter blades 44 and in abutting relation thereto. The cutter bar 46 provides a cutting edge at the end of the rotating cutter blades 44. The cutter bar 46 can also be turned over to use the cutting edges provided on all four edges of the cutter bar.

Figure 5:
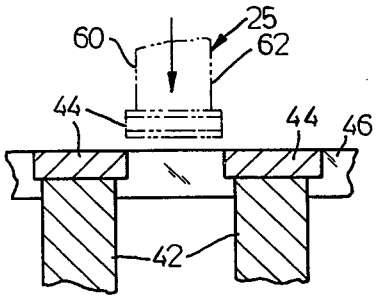
FIG. 5 is a view taken on line 5—5 of FIG. 4 showing the arrangement of the cutter blade with respect to the support plates in the cutter bar assembly.
Figure 7:
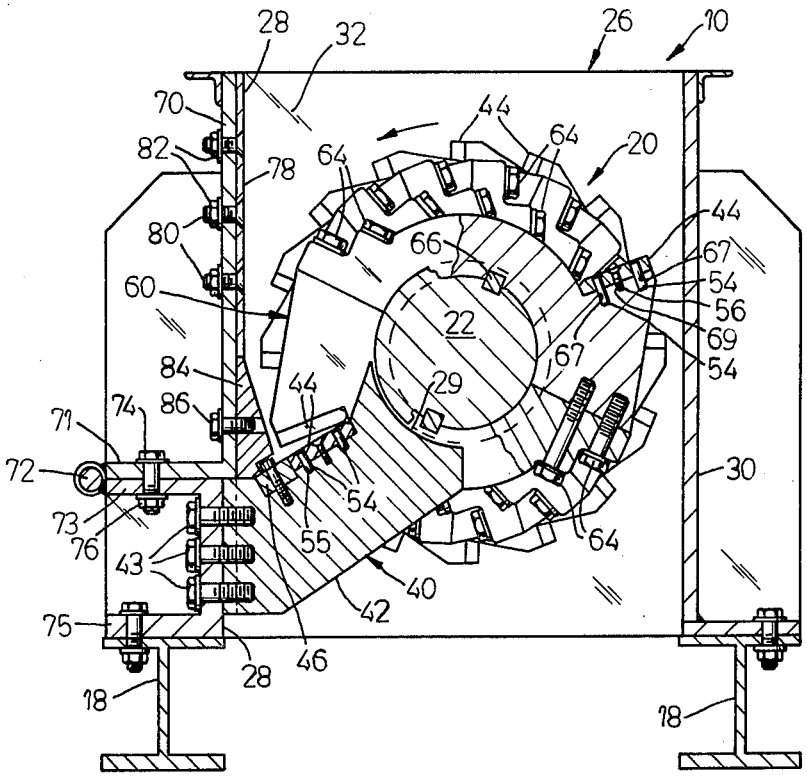
FIG. 7 is an end view in section of the shredding assembly showing the inclined relation of the cutter blades on the rotary cutter blade assembly and the cutter bar assembly with the front wall portion closed.
Figure 8:
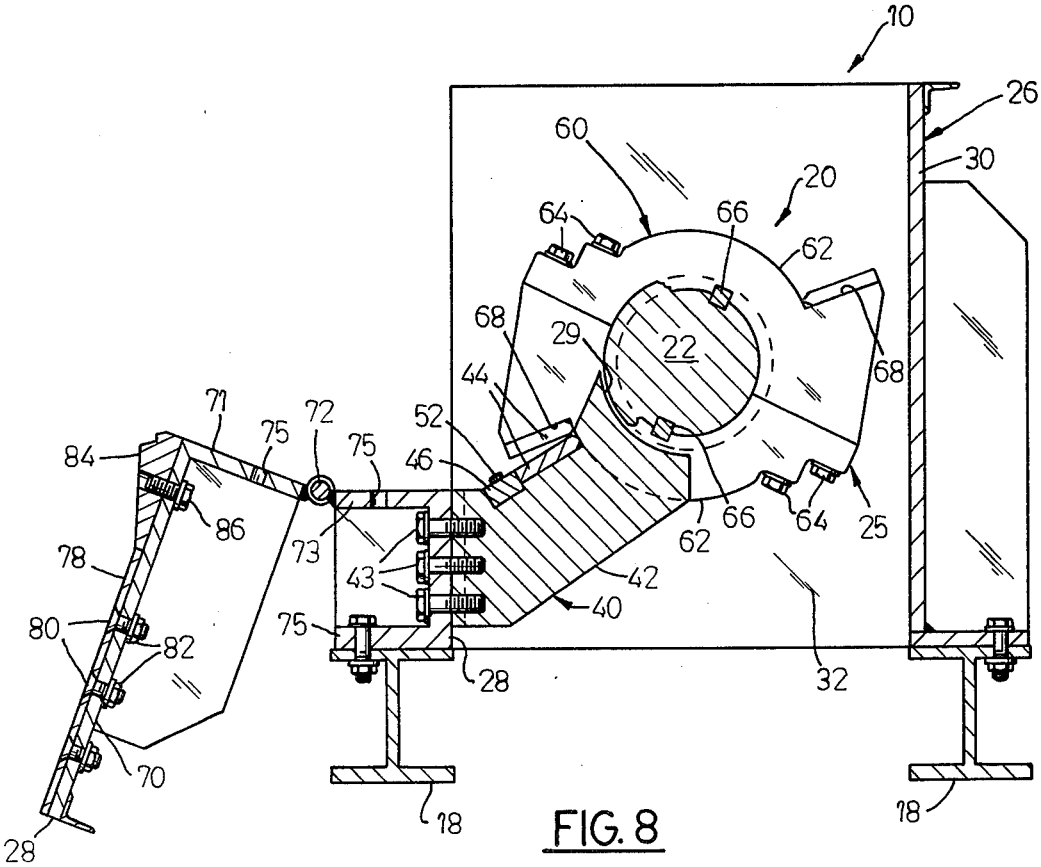
FIG. 8 is a view similar to FIG. 7 showing the portion of the front wall opened to allow access to the shredding assembly.

Material which has been shredded is allowed to drop freely through the shredder assembly by providing a clearance between the cutting edge of the cutter blade and the wall of the blade holders 42. Referring to FIG. 5, the width of the cutter blades 44 is shown slightly larger than the width of the blade holders 42. A similar clearance is provided between the cutter blades 44 and the blade holders of the rotary cutter blade assembly as described hereinafter. This clearance is sufficient to allow material which has been sheared through the cutter bar assembly to move with the rotary cutter blades past the support plate 42 so it can fall from the hopper assembly after being sheared.

ROTARY BLADE ASSEMBLY

The rotary cutter blade assembly 25 includes a plurality of blade support assemblies 60 mounted at equally spaced intervals in a parallel relation on the shaft 22. It should be noted that the shaft 22 is grooved at spaced intervals to positively locate the support assemblies 60 on the shaft 22. Each assembly 60 is split into two identical half sections or plates 62, FIGS. 7 and 8, which are mounted on the shaft 22 and secured in position by means of a number of hex head bolts 64. Locking keys 66 are provided in grooves on the shaft 22 to engage slots in the support assemblies to hold the assemblies in position.

Each of the plates 62 includes a cutter blade surface 68 having a threaded opening 69 and a pair of blind bores 67. A pair of dowls or pins 54 are positioned in the blind bores 67.

The cutter blades 44 are mounted on the surface 68 of the plates 62 by positioning the cutter blade on the surface with the pins 54 extending partially into the openings 50 in the cutter blades. A flat head screw 56 is used to secure the cutter blade to the surfaces 68 by turning the screw into the threaded opening 69. As indicated previously, in referring to FIG. 5, the cutter blade 44 is slightly wider than the width of the plate 62 to allow clearance for shreaded material.

Figure 9:
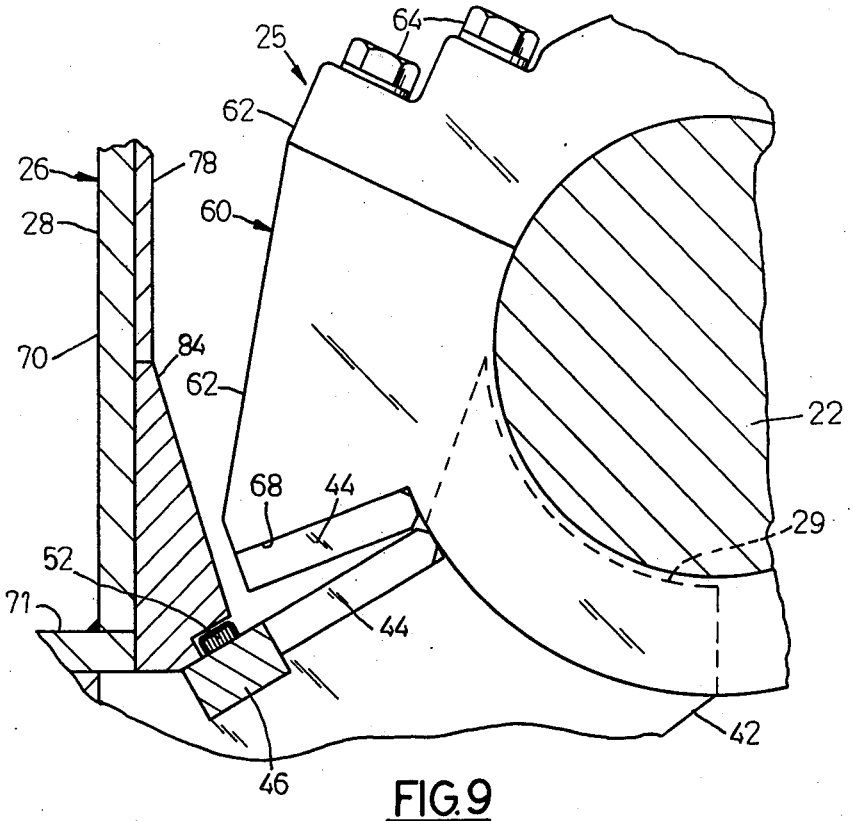
FIG. 9 is an enlarged end view of a portion of the cutter blade assembly showing the downwardly inclined relation of the cutter blades to the shaft of the rotary cutter blade assembly as well as the guide wall for directing materials into the shredding assembly.
Figure 10:
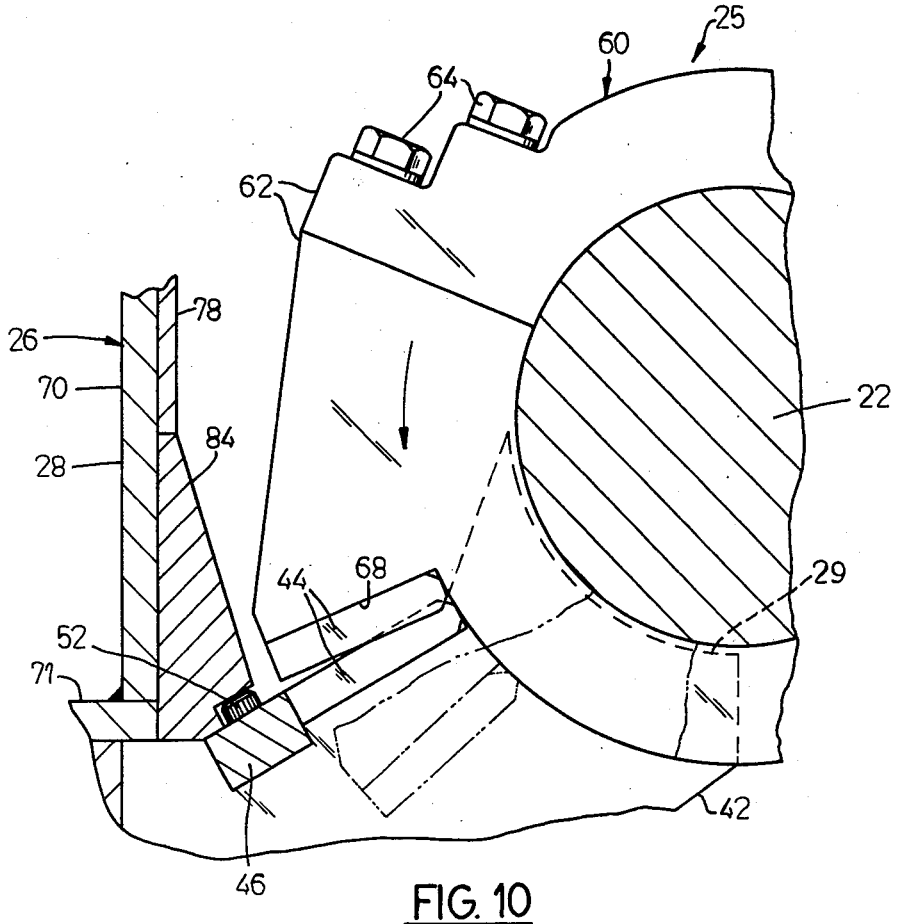
FIG. 10 is a view similar to FIG. 9, showing the sequential arrangement of the cutter blades on the rotary blade assembly as they rotate into engagement with the cutter bar.

In accordance with one aspect of the invention, the cutter blades 44 on both the rotary blade assembly and the cutter bar assembly are arranged to extend downwardly and outwardly from the axis of the shaft 22. Referring to FIGS. 9 and 10 it will be noted that the cutter blade 44 mounted on the plate 62 on the rotary blade assembly acts to push the waste material toward the cutter bar assembly as it passes through a horizontal plane extending through the axis of the shaft 22. The cutter blades 44 on the rotary cutter blade assembly angularly intersect the cutter blades 44 on the cutter bar assembly at an acute angle to provide a shearing or scissor action in cutting the waste material.

Referring to FIG. 10, it will be noted that the cutter bar blades 44 on the rotary blade assembly sequentially engage cutter blades on the support plates so that only one blade is cutting at any particular time. The torque required at any particular time will be only that torque necessary to cut waste material at one point in the entire shredder assembly.

It should also be noted that the cutter blades 44 are both symmetrical and identical in dimensions so that they are interchangeable. The blades 44 can be interchanged with each other or can be reversed or turned to another position at the same place to increase the life of the cutter blades.

ACCESS DOOR

Easy access to the shredding assembly 20 for maintenance and repairs is provided by means of an access door 70 which comprises a portion of the front wall 28 of the housing 26. The access door 70 in side elevation is shown in the form of an L having a base leg 71. The front wall 28 is in the form of a channel member having upper and lower legs 73 and 75. The access door is hingedly connected to the channel member by providing a hinge pin 72 at the end of the base leg 71 and at the end of the upper leg 73 of the channel member. The access door is secured to the channel member by means of a number of bolts 74, and nuts 76, which are positioned in holes 75 provided in the base leg 71 and upper leg 73 of the front wall. The door can be opened by merely removing the bolts 74 and nuts 76 so that the front portion of the wall can be pivoted outwardly to allow service personnel to enter the hopper 26.

Means are provided on the inside surface of the access door 70 to minimize wear. Such means is in the form of a wear plate 78 secured to the door by means of flat head bolts 80 and nuts 82.

Means are provided at the bottom of the access door to aid in guiding the material into the cutter bar assembly. Such means is in the form of an inclined plate 84 which is secured to the access door by bolts 86. The plate 84 being located in close proximity to the end of the cutter blades on the rotary cutter assembly. Material being pushed into the cutter bar assembly will pass along the surface of the guide plate 84 until it is pushed through the cutter bar assembly.

FIGS. 11 AND 12

Figure 12:
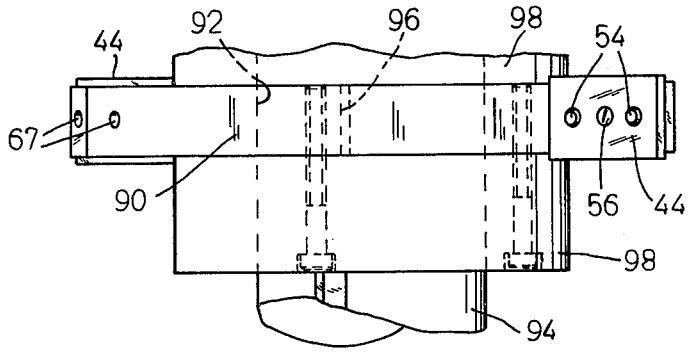
FIG. 12 is a view taken on line 12—12 of FIG. 11 showing the one piece blade support plates and spacers.
Figure 11:
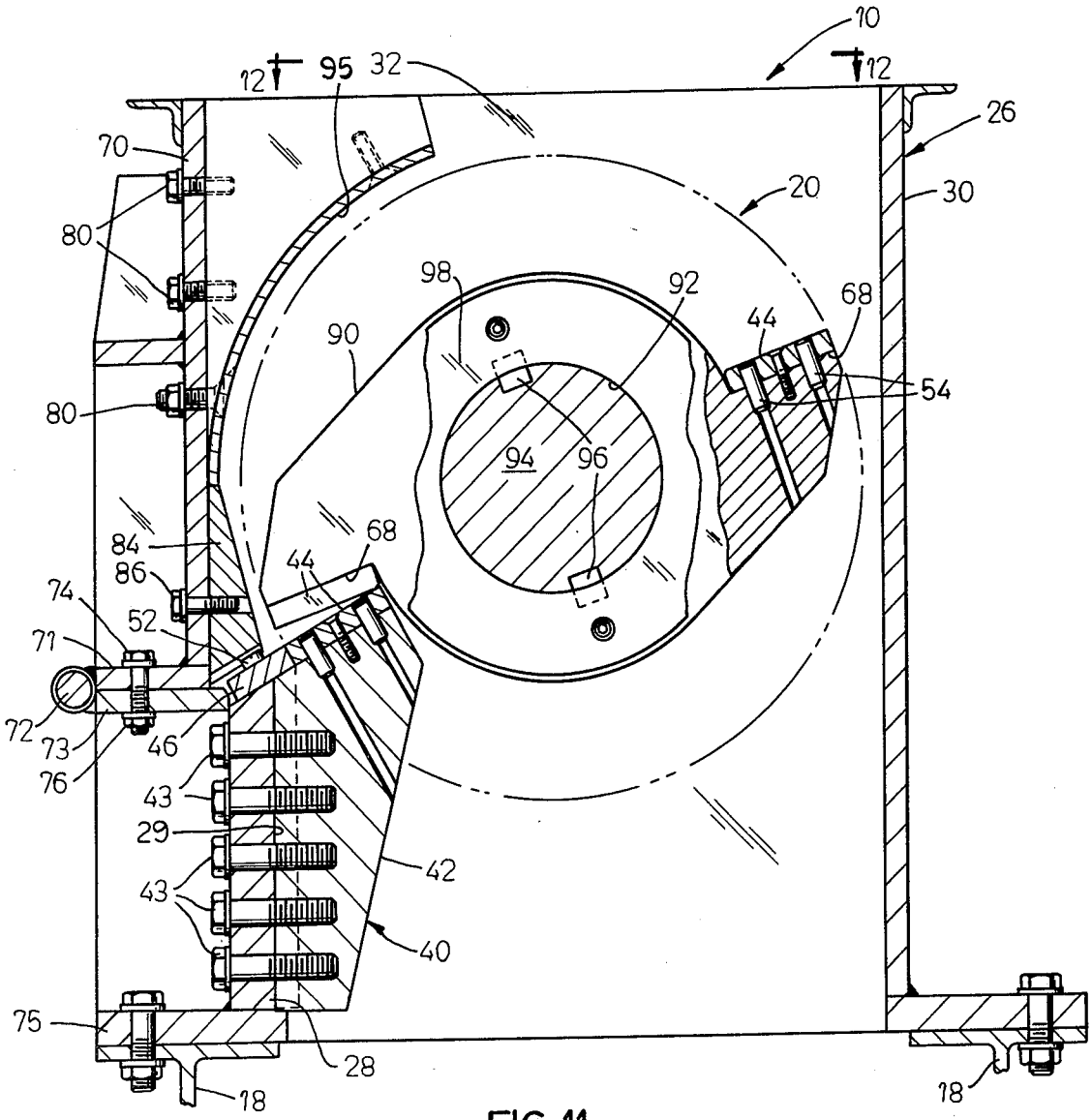
FIG. 11 is a view of an alternate embodiment of the rotary cutter blade assembly.

In the embodiment of the invention shown in FIGS. 11 and 12, an alternate form of rotary cutter blade assembly and stationary cutter bar assembly are shown. In this embodiment the blade support plates 90 are solid one piece structures having a central aperture 92. Each plate is keyed to the shaft 94 by means of keys 96. The blade support plates 90 are equally spaced on the shaft 94 by means of spacer rings 98. This arrangement simplifies the shaft construction by eliminating the grooves as well as reducing the diameter of the shaft 94. Any appropriate means can be provided at each end of the shaft to hold the support plates in position.

It should also be noted that the front wall 28 is moved inwardly of the access door 70. The stationary cutter bar assembly is mounted on the front wall 28 with the cutter bar 46 supported on the upper edge of the front wall 28. The front wall 28 thus provides a support for the cutter bar 46 and thereby relieves part of the stress on the bolts 43. The stress on the bolts is further relieved by positioning the stationary blade holders 42 in slots 29 provided in the front wall 28.

An alternate form of guide means is shown for directing tires into the shredder assembly. The guide means includes a curved or arcuate wall 95 mounted on the access door 70 by bolts 80. The tires are fed into the shredder assembly over the back wall 30 and directed into the rotary cutter by the curved wall 95.

It should be understood that the alternate embodiments can be incorporated into the invention described above.

The embodiments of the invention in which an exclusive property or privilege is claimed are defined as follows:

1. A shredding apparatus comprising,
a housing having a front wall, a back wall, and a pair of end walls,
a portion of said front wall being pivotally connected to said front wall to allow access to the housing,
a cutter bar assembly mounted on said front wall, said assembly including a plurality of blade holders mounted in an equally spaced parallel relation on the front wall of said housing,
a cutter blade removably mounted on each of said blade holders and a cutter bar mounted at the end of said cutter blades in a transverse relation to said cutter blades,
a rotary cutter blade assembly including
a shaft journaled for rotary motion in said housing,
a plurality of rotary support assemblies mounted on said shaft in parallel equally spaced relation for rotary movement through the spaces between said blade holders each of said rotary support assemblies including a pair of cutter blades mounted in a position to cooperate with said cutter blades and said cutter bar on said cutter bar assembly, said cutter blades on said cutter bar assembly and said cutter blades on said rotary supports assemblies being interchangeable.

2. The shredding apparatus according to claim 1 wherein each of said cutter blades are wider than each of said blade holders to provide clearance for shredded material through said apparatus.

3. The shredding apparatus according to claims 1 or 2 wherein said front wall includes a plurality of slots and each of said blade holders is positioned in one of said slots.

4. The shredding apparatus according to claims 1 or 2 wherein said cutter blades on said blade holders extend upwardly toward said shaft and said cutter blades on said rotary assembly intersect the cutting edge on the cutter blades on the blade holders at an acute angle.

5. The shredding apparatus according to claim 1 including means on said hinged portion of said front wall for guiding waste material into the rotary cutter blade assembly.

6. The apparatus according to claim 5 wherein said guide means is curved.

7. The shredding apparatus according to claim 1 wherein said shaft includes a plurality of equally spaced grooves and one of said support assemblies is mounted in each of said grooves.

8. The shredding apparatus according to claim 1 wherein said rotary support assemblies each include a solid one piece support plate mounted on said shaft, and a spacer ring mounted on said shaft between said support plates.

9. A shredding apparatus comprising,
a housing,
a cutter bar assembly mounted within said housing,
a plurality of cutter blade assemblies mounted in said housing for rotary movement through said stationary cutter bar assembly, said stationary cutter bar assembly and said cutter blade assemblies including, cutter blades which are removably mounted thereon and interchangeable with respect to each other.

10. The shredding apparatus according to claim 9 wherein said cutter blades on said cutter bar assembly are located in a downwardly and outwardly inclined position.

11. The shredding apparatus according to claims 9 or 10 wherein said housing includes a movable portion in one of said walls which can be opened to allow access to said cutter bar assembly and said cutter blade assemblies in the housing.

12. The shredding apparatus according to claims 9 or 10 wherein said housing includes means for guiding waste material into the cutter blades of said cutter bar assembly and said cutter blade assembly.

13. A shredder comprising:
a hopper and a shredding assembly in said hopper, said shredding assembly including
a stationary cutter bar assembly having a plurality of cutter blades supported in a parallel spaced relation in said hopper,
and a rotary cutter blade assembly having a plurality of cutter blades positioned to pass through the spaces between the cutter blades on said stationary cutter bar assembly,
each of said cutter blades is identical to and interchangeable with each of the other cutter blades.

14. The shredder according to claim 13 wherein each of said cutter blades intersect at an acute angle with a corresponding cutter blade whereby the material is shreared as it passes through the cutter blades.

15. The shredder according to claims 13 or 14 wherein said stationary cutter bar assembly includes a cutter bar positioned in a transverse abutting relation to said cutter blades on said stationary cutter bar assembly to define a cutting edge at the ends of the cutter blades on said rotary cutter assembly.

16. The shredder according to claims 13 or 14 wherein said cutter blades on said cutter bar assembly are disposed at a downwardly and outwardly inclined angle.

17. The shredder according to claim 13 wherein said hopper includes a moveable wall portion to allow access to said shredder assembly.

18. The shredder according to claim 17 including a guide means on said wall portion for directing waste material into said shredder assembly.

19. The shredder according to claim 18 wherein said guide means is a curved wall.

20. A shredding assembly including a stationary cutter bar assembly and a rotary blade assembly, the improvement comprising a plurality of identical cutter blades on each of said assemblies; said blades having cutting edges on all sides whereby said blades can be reversed or interchanged with each other.

21. The shredding assembly according to claim 20 wherein said blades are disposed to provide a scissor type shearing action in cutting the waste material.

22. The shredding assembly according to claims 20 or 18 wherein each of the cutter blades on the cutter bar assembly are disposed at an upwardly inclined angle.

23. The shredding assembly according to claims 20 or 21 including a cutter bar at said stationary cutter bar assembly arranged to provide a cutting edge at the ends of the cutter blades on said stationary cutter blade assembly.

24. A shredding apparatus comprising:

a housing, a fixed cutter bar assembly mounted in said housing and having plurality of cutter blades mounted thereon in a parallel spaced relation to each other and a cutter bar mounted in a transverse relation to the cutter blades, and a rotary cutter assembly rotatably mounted in said housing, said rotary cutter assembly including a number of cutter blade assemblies each having a cutter blade positioned to pass through the spaces between the cutter blades on said cutter bar assembly, the cutter blades on said stationary cutter bar assembly and said rotary cutter assembly being identical and interchangeable.

25. The apparatus according to claim 24 wherein said cutter blades on said stationary cutter bar assemblies are inclined upwardly toward said rotary cutter assembly, whereby said cutter blades on said rotary cutter assembly act to pull material into the space between the cutter blades on the stationary cutter bar assembly.

* * * * *